United States Patent [19]

Reuter

[11] Patent Number: 4,616,923

[45] Date of Patent: Oct. 14, 1986

[54] POTENTIAL CONTROL ON PHOTOSENSITIVE LAYERS IN ELECTROSTATIC CHARGING PROCESSES

[75] Inventor: Klaus Reuter, Wiesbaden, Fed. Rep. of Germany

[73] Assignee: Hoechst Aktiengesellschaft, Frankfurt am Main, Fed. Rep. of Germany

[21] Appl. No.: 711,711

[22] Filed: Mar. 14, 1985

[30] Foreign Application Priority Data

Mar. 16, 1984 [DE] Fed. Rep. of Germany ..... 3409701

[51] Int. Cl.[4] ..... G03G 15/00

[52] U.S. Cl. ..... 355/14 E; 355/14 C; 355/14 R; 430/35

[58] Field of Search ..... 355/3 R, 8, 14 E, 14 R, 355/3 CH, 14 CH, 14 C; 430/31, 35

[56] References Cited

U.S. PATENT DOCUMENTS

| | | | |
|---|---|---|---|
| 3,321,307 | 5/1967 | Urbach | 96/1 |
| 3,438,705 | 8/1969 | King | 355/8 |
| 3,749,488 | 7/1973 | DeLorme | 355/8 X |
| 3,762,811 | 10/1973 | Matsumoto | 355/3 |
| 3,788,739 | 1/1974 | Coriale | 355/17 |
| 3,864,035 | 2/1975 | Kuehnle | 355/3 R X |
| 3,944,354 | 3/1976 | Benwood et al. | 355/3 R |
| 4,153,364 | 5/1979 | Suzuki et al. | 355/14 E |
| 4,215,930 | 11/1980 | Miyakawa et al. | 355/14 |
| 4,248,524 | 2/1981 | Takahashi | 355/14 |
| 4,348,099 | 9/1982 | Fantozzi | 355/14 E |
| 4,355,885 | 10/1982 | Nagashima | 355/14 |
| 4,361,395 | 11/1982 | Washio et al. | 355/14 E X |
| 4,420,247 | 6/1983 | Suzuki et al. | 355/14 |

FOREIGN PATENT DOCUMENTS

| | | |
|---|---|---|
| 0098509 | 4/1984 | European Pat. Off. . |
| 2857218 | 8/1978 | Fed. Rep. of Germany . |
| 57-22272 | 5/1982 | Japan . |

*Primary Examiner*—A. C. Prescott

*Attorney, Agent, or Firm*—Schwartz, Jeffery, Schwaab, Mack, Blumenthal & Evans

[57] ABSTRACT

The light-sensitive layer of a printing plate is charged to a given surface potential which is measured by means of a stationary or moving potential detector. The potential ratio, which changes during the exposure, is continuously compared with a given set value, and the exposure is terminated when the changing potential ratio is in agreement with the given set value. The measurement of the surface potential and of the potential ratio is carried out in a bright area of the light-sensitive layer, which area is located outside the area of the latent electrostatic image.

The potential detector may be connected via a signal converter and an amplifier to a microprocessor control which actuates a shutter via a digital output. In the microprocessor, a program for controlling a corona electrode and a developing electrode is stored, which program actuates the corona control and the developing electrode control via a digital/analog output and high-voltage amplifiers.

25 Claims, 10 Drawing Figures

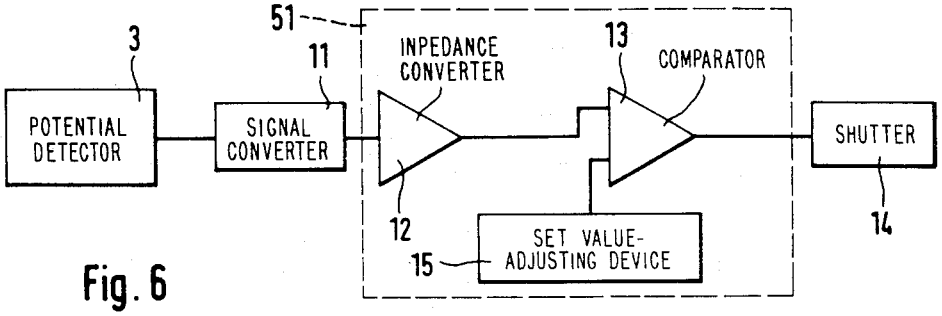
Fig. 6
Fig. 7
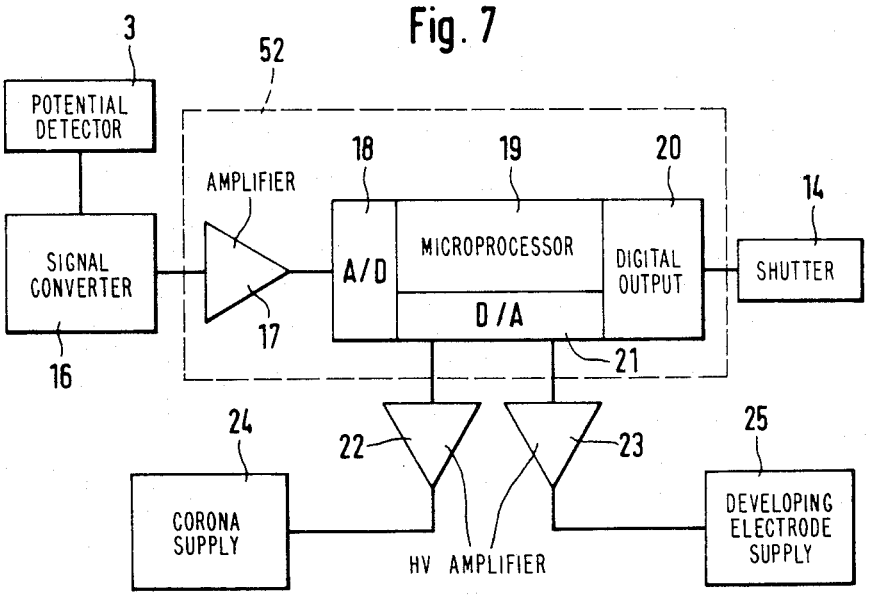

POTENTIAL CONTROL ON PHOTOSENSITIVE LAYERS IN ELECTROSTATIC CHARGING PROCESSES

BACKGROUND OF THE INVENTION

The invention relates to a method for maintaining a constant potential ratio in the exposure of electrostatically charged light-sensitive layers on carriers, on which an electrostatically latent image of an original is formed during the exposure.

Long-term uniform quality of printing plates, on the charged light-sensitive layers of which electrostatically latent images are obtained by exposure and are developed with a toner, requires that the mutual potential ratios of charge, residual charge, and counter-voltage are precisely maintained. In order to achieve this, the electro-photographic layer must be produced within narrow tolerances and an exposure device, for example a camera, must be adapted to working conditions which may differ from one printing plate to another. The exposure control of conventional cameras consists in general of a timer which switches off the shutter and the light source after a preselected time. An improved control is possible with so-called light dosimeters which measure the light arriving in the zone of the original and correct the exposure time accordingly. In this way, different lamp outputs, caused by light source agin, by fluctuations in the supply voltage, or by dirt on the reflectors, are partially compensated for. The setting required for a desired residual voltage of the exposed printing plate can only be found with the aid of trial plates which are exposed for different periods, so that the exposure step is terminated at different residual voltages of these trial plates. That trial plate which allows satisfactory printing also gives the requisite setting for the desirable residual voltage at the end of exposure. The setting thus obtained cannot be retained, however, since the residual voltage resulting at an unchanged setting varies with the charging and the sensitivity of the light-sensitive layer of the printing plate. These parameters depend on manufacturing tolerances, type of plate, atmospheric humidity, temperature, pre-exposure, dirt on the corona, and the like.

German Offenlegungsschrift No. 3,049,339 has disclosed an electrostatic recording device with a measuring device in the form of an electrometer for measuring the surface potential of a light-sensitive layer. The surface potential of a latent image on the light-sensitive layer is measured, the surface potential being registered as an a.c. voltage signal, and various conditions for producing the image, such as, for example, the charging voltage and the developing bias, are controlled from the measured surface potential. For this purpose, a first control device contains a stored program for a sequence control of the device generating the latent image, and a second control contains a stored program for controlling the conditions for the formation of the latent image by means of the device generating the latent image or for controlling the conditions for development by the developing device by means of output signals from the surface potential-measuring device.

German Patent No. 2,857,218 has disclosed a method for keeping the optimum conditions constant in electrophotographic duplicating, wherein, for the formation of an electrostatic latent image on a light-sensitive carrier, the carrier is charged electrostatically and exposed and, next to the electrostatic image of the original on the carrier, an electrostatic latent reference image is formed, the potential of which is measured and an adjustable parameter for the duplication is adjusted in accordance with the measured potential reference image. The reference image is generated by forming light and dark areas on the light-sensitive carrier and accordingly has areas of low potential and high potential. The potentials of both areas are measured and, in the event of a deviation of the potentials of the reference image from given set values, the adjustable parameter, allocated to the particular area, is changed until the potentials of the electrostatic latent reference image have been brought to the given set values. If the exposure of the light-sensitive carrier is insufficient (in which case the potential is in general too high), signals are generated for automatically correcting the voltage of the illumination device, the width of the slit opening, or the like, or to provide a corresponding correction figure for the potential. If the charge of the light-sensitive carrier is insufficient, that is to say the potential is too low altogether, signals are provided for automatically increasing the voltage of the charging device or for carrying out a corresponding correction of the potential. If both the exposure and the charge are not at desired levels, signals are provided for correcting both parameters in such a way that, after the passage of a few copies, the given set values can be reached. This means that follow-up control of the voltage of the charging device and/or an increase in the exposure intensity takes place, the starting point for these corrections being the measurement of the surface potential of an electrostatic latent reference image on the light-sensitive carrier.

European Patent Application No. 0,098,509 describes a method for controlling the electrostatic charging of a photoconductor surface by means of a corona-charging device. In this case, the charged photoconductor surface is partially discharged by exposure, and signals are measured which allow a comparison of the exposed and unexposed areas of the photoconductor surface. The charging device is controlled according to these comparison signals. The comparison signals are also used for regulating the light intensity of an exposure lamp and the duration of exposure. For this purpose, when the measured signal agrees with a stored set value of the unexposed area of the photoconductor, the corona-charging voltage is regulated to a value corresponding to the matched levels of measured signal and set value. The measured signal belonging to this corona-charging voltage in the exposed area of the photoconductor regulates the exposure lamp in agreement with stored data of the lamp characteristics, which data take into account the aging of the lamp, non-linear influences due to voltage fluctuations, a shift in the color temperature of the exposure lamp relative to the photoconductor sensitivity, and the like, in order to charge the exposed area sections of the photoconductor to the desired surface voltage. In this method, the corona-charging voltage, the exposure intensity and the duration of exposure are regulated in such a way that, at the start of toner application to the photoconductor, a given voltage exists in the exposed areas. A continuous measurement of the decreasing photoconductor voltage and of the exposure process in the exposed area sections does not take place.

U.S. Pat. No. 3,438,705 describes an exposure and developing device, in which the background density of a copy is automatically controlled by means of a photosensitive device which scans the material to be copied.

The potential obtained on scanning the background is applied during the exposure to the development plate, in order to prevent overcharging of the plate. In this device, the exposure which the plate to be developed receives in a background area is measured. From this measured exposure value and the initial potential of the plate to be developed, a new potential is obtained which is equal to the potential resulting from the exposure of the plate, and this potential is applied to the development electrode and to the plate during the development. Control of the duration of exposure, based on the voltage contrast between the exposed and unexposed areas of the plate to be developed is not envisaged. Rather, the potential of the latent image on the printing plate is registered and, by means of the signal corresponding to this potential, the conditions which are necessary for generation of the image are controlled. Thus, there is follow-up control after the measurement until the desired set values have been reached.

The known methods and devices share the common feature that the predetermined duration of exposure does not adequately take into account any possible changes in the light-sensitive layers from one carrier to another and there is no control executed via the residual charge of the exposed layer of the carrier or of the exposed plate.

SUMMARY OF THE INVENTION

It is the object of the invention to develop a method of the type described at the outset, in such a way that the duration of exposure of a light-sensitive layer of a carrier is determined by reference to fixed given potentials or potential differences on the light-sensitive layer discharged in the bright areas as a result of the exposure. Within the scope of this object, an arrangement for carrying out the method is also to be provided.

According to the invention, this object is achieved by a method comprising the steps of charging the light-sensitive layer to a given surface potential, measuring the surface potential by means of an electrostatic potential detector, continuously comparing the measured surface potential with a defined set value, and terminating the exposure when the measured surface potential agrees with the given set value.

The measurement of the surface potential is preferably carried out in a bright area of the light-sensitive layer outside the area of the latent electrostatic image. For this measurement, various models of electrostatic measuring probes are known, but these have in general the disadvantage that they are not transparent probes and thus, during the exposure, cover that part of the light-sensitive layer which lies below them. Thus, this part of the light-sensitive layer is not discharged and the potential of a residual charge can therefore not be measured. In addition, there is a method of charge measurement which entails the use of a conductively-coated glass plate in a coulometer, but this has the disadvantages that the distance between the measured surface and the printing plate directly affects the measured result, that the result obtained gives only a relative value and not an absolute value because of the reduced transmission as compared with the printing plate which is not covered by the measuring probe, and that a change in transmission, affecting the measured result, is caused by dust deposition on the glass plate.

In an advantageous embodiment of the method according to the invention, the set value is given in accordance with the residual potential of the light-sensitive layer after the discharge of the bright areas of the latent image, or in accordance with the given potential difference between the bright and dark areas of the exposed latent image. Advantageously, for each given surface potential of a charge, a defined residual potential is stored, or can be read in, and the surface potential decreasing during the exposure is continuously compared with the defined residual potential which is allocated to the given surface potential at the start of the exposure.

The exposure is terminated as soon as the magnitude of the decreasing surface potential is equal to or smaller than the residual potential.

The method is carried out with an apparatus comprising: a potential detector arranged to detect the potential of an electrostatic charge on the light-sensitive layer, and producing a.c. signals indicative of the detected potential; a signal converter responsive to the potential detector for converting the a.c. signals into d.c. signals; a control device responsive to the signal converter for comparing the value of the d.c. signals with a set value and for outputting a control signal when the value of the d.c. signals and the set value achieve a predetermined relationship; and shutter means, responsive to the control device, for terminating exposure of the light-sensitive layer in response to the presence of the control signal.

The potential detector of the device is a detector which is preferably fitted for operation in transmitted light with oblique light incidence. Of course, a detector for perpendicular light incidence can also be used, but with the disadvantage that an image of the detector is formed in the image area or, when used at the edge of the plate, the measured value is affected by the shadow in the measuring field. The potential detector operates in accordance with the compensation principle which is known to one of ordinary skill in the art and which will be explained below.

The invention brings the advantages that the control of the duration of exposure is effected by monitoring the discharge curve of the light-sensitive layer or the voltage contrast between the bright and dark areas of the exposed light-sensitive layer, whereby a uniform quality of the print image of the developed light-sensitive layer is obtained and relatively wide tolerances in the physical properties of the light-sensitive layer of the printing plates can be compensated.

BRIEF DESCRIPTION OF THE DRAWINGS

The invention is described in more detail below by reference to the drawings in which:

FIG. 6 shows a block diagram of an arrangement for controlling the exposure on the basis of the measurement of the residual charge potential of an exposed printing plate;

FIG. 7 shows a block diagram of an arrangement for controlling the exposure, corona voltage and developer voltage, based on the measurement of the potential difference between light and dark areas of an exposed printing plate;

DETAILED DESCRIPTION OF THE PREFERRED EMBODIMENTS

Figure 1:
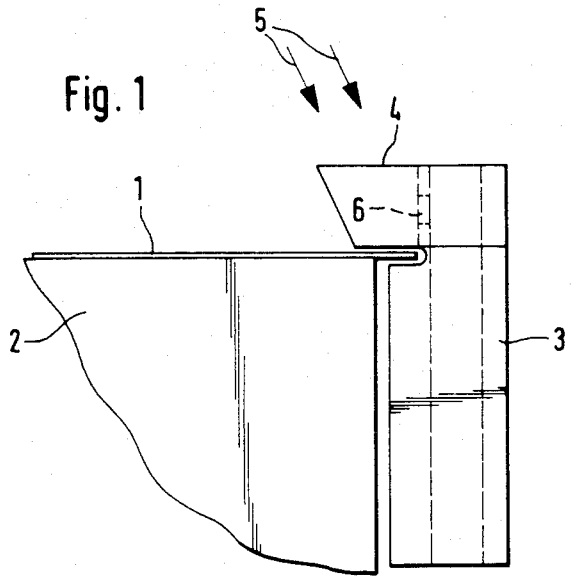
FIG. 1 shows a diagrammatic side view of a stationary potential detector for the measurement of the surface potential of the light-sensitive layer of a printing plate.

FIG. 1 diagrammatically shows a printing plate 1 which rests on an exposure table 2 and is retained, for example, by suction air. The printing plate 1 has been charged beforehand in a known manner by means of a corona-charging device, not shown, to a defined potential and has been transferred to the exposure table 2. An edge strip of, for example, 20 mm width of the printing plate projects beyond the exposure table 2 and is located below a screen 4 of a potential detector 3. This potential detector is generally in a stationary arrangement at the edge of the exposure table 2, but it is also possible to fit the potential detector 3 pivotably and to pivot it for each measurement over the edge of the printing plate 1. In the region of the screen 4 of the potential detector 3, a measuring electrode 6 is drawn diagrammatically. One side wall of the screen 4 is inclined relative to the horizontal, in order to allow for oblique light incidence 5 and thus to avoid formation of shadows by the side walls of the screen 4 on the measuring field which is to be exposed and which is located inside the screen 4 which is open downwards and upwards. The walls of the screen 4 are preferably made very thin, so that any image of them, if formed, on the edge zone of the printing plate 1 hardly affects the measurement. The measuring area located below the screen 4 amounts to, for example, 11 mm×15 mm, so that the ratio of the measured exposed area to the unexposed area directly below the side walls of the screen 4 is of an order of magnitude, at which an error in the potential measurement, caused by the formation of shadows of the side walls of the screen 4, can be minimized. Investigations have shown that the shadow zones, caused by an image of the side walls of the screen 4 of a conventional potential detector on the edge zone of the printing plate 1 during the exposure, give different charge zones below the screen 4. These charge zones, together with the distance between the measuring electrode and the printing plate 1 maintained by means of sliding pieces or spacers on the potential detector and amounting to 0.2 to 1.5 mm, in particular 1.2 mm, in order to prevent contact during the transport of the printing plate 1 up to its final position on the exposure table 2, distort the electric field between the shadow zones and the measuring electrode, and thus the measured result. This can have the result that, when using a conventional, commercially available potential detector with a small screen aperture which amounts to only about one third of the above-indicated screen aperture of 11 mm×15 mm, starting from a surface potential of 400 V after charging before exposure, a residual charge potential of 100 V is measured instead of an actually present residual charge potential of 65 V.

The surface potential of the exposed printing plate 1 is measured with the potential detector 3 outside the actual image area of the printing plate 1, so that even a possible image of the contours of the screen 4 within the edge zone of the printing plate 1 does not interfere, since the finally developed printing plate 1 is usually clamped onto a cylinder in a printing press and, as a rule, the edge zone of about 20 mm of the printing plate 1 is located outside the printing zone on at least one side.

Figure 2:
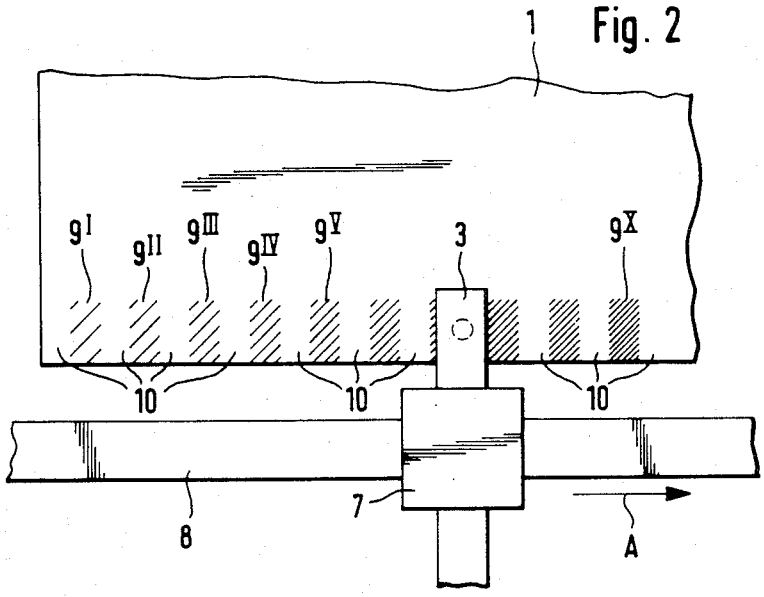
FIG. 2 shows a plan view of a diagrammatically represented potential detector which is movable along an edge of a printing plate.

FIG. 2 diagrammatically shows a movable potential detector 3 which is moved along of edge of a printing plate 1. The potential detector 3 is fitted in a holder 7 which is displaceable along a guide 8 in the direction of the arrow A.

The holder 7 is moved, for example, by means of a cable which is not shown. It is also possible to equip the guide 8 with a threaded spindle which rotates and thus displaces the holder 7 which is in engagement with the spindle. In each case, the potential detector 3 is moved, at the start of exposure, by means of a motor along the guide 8 over an edge zone of the printing plate 1. In the edge zone, a surface potential distribution serving as a comparison standard for the bright/dark distribution in the original is indicated by the hatched dark areas $9^I$ to $9^X$ and the interposed bright areas 10 in a strip pattern. The hatchings of the dark areas $9^I$ to $9^X$ in different degrees of shading indicate the different surface potentials in the corresponding dark areas. The ratio of the widths of the dark areas to those of the bright areas is 1:1, and the area width is adapted to the resolution of the potential detector and is in practice between 1 and 8 mm. The strip pattern is obtained by forming an image of a bar pattern together with that of the original. The bar pattern adjoins the original and the blackness densities of the dark areas of the bar pattern are known.

The strip pattern of bright and dark areas is located in the edge zone of the printed plate 1, which zone, when the printing plate is clamped to the impression cylinder, is located outside the printing zone. In this manner, the edge zone is not adversely affected by the strip pattern. The strip pattern enables the exposure time or duration to be controlled on the basis of a given potential difference between bright and dark areas, which is regarded as superior to exposure time control effected by reaching a fixed residual charge potential of the surface of the printing plate, since the light-sensitive layers of the printing plates in general show a non-uniform behavior in the dark areas, that is to say in the unexposed areas. This is caused, on the one hand, by unequal photochemical and/or physical properties of the light-sensitive layers of the printing plates themselves, which inequalities can occur even within the same lot of printing plates, such as, for example, different decrease rates in the dark and different light sensitivity maxima of the layers. It is caused, on the other hand, by the different blackness densities of the dark areas of the originals, by scattered light due to dirt on the imaging optics, fluctuations in the charging voltage, and exposure times of different lengths on the individual printing plates.

Figure 3:
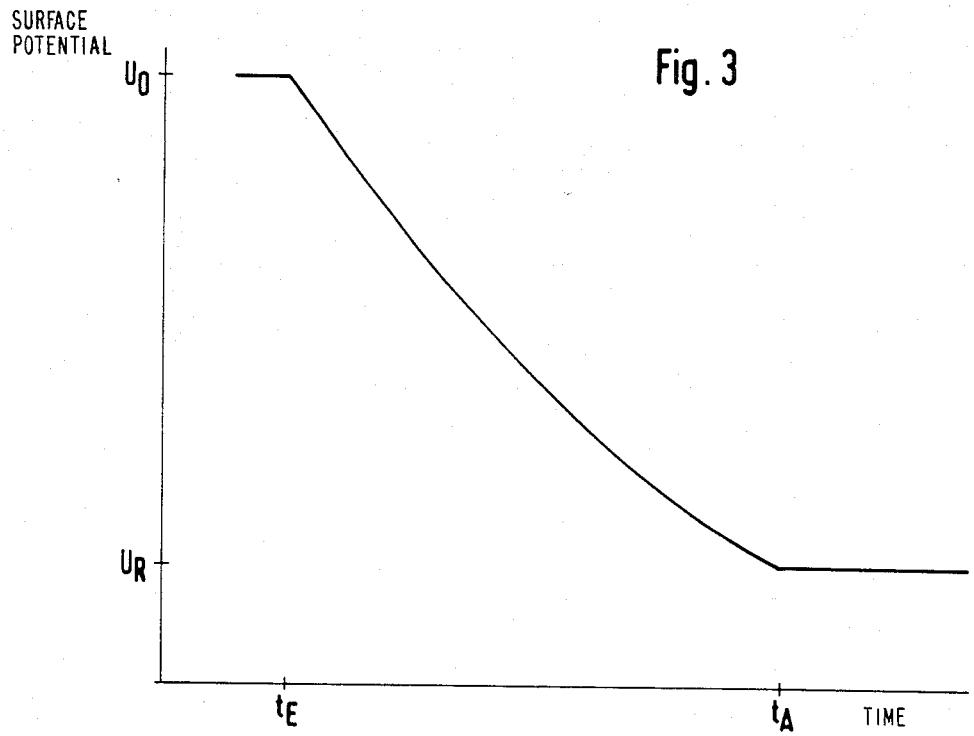
FIG. 3 shows the change of the surface potential of a bright area in the latent electrostatic charge image on a printing plate as a function of the exposure time, measured by a stationary potential detector.

FIG. 3 diagrammatically shows the change in the surface potential of the bright area of a charged printing plate as a function of the exposure time. The potential is measured by means of a stationary potential detector. Initially, the printing plate is charged to the surface potential $U_O$ and the exposure is started at the switch-on time $t_E$. The discharge of the bright area in the latent electrostatic charge image takes place during the exposure in accordance with the curve shown, the surface potential decreasing exponentially. The particular surface potential, measured continuously, is continuously compared with a given set value of the surface potential $U_R$ of the residual charge of the photoconductive layer of the printing plate and, as soon as the measured surface potential agrees with the given surface potential $U_R$ which happens at time $t_A$, the exposure is terminated by switching off the exposure source.

Figure 4:
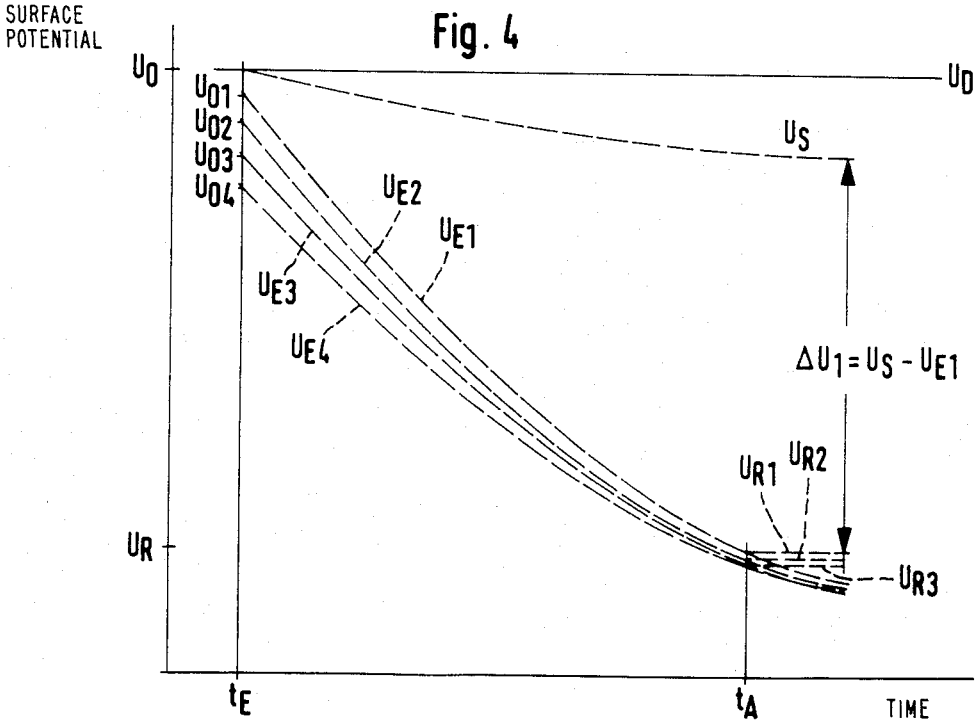
FIG. 4 shows the discharge curves and the potential difference between dark and bright areas in the latent electrostatic charge image on a printing plate as a function of the exposure time, measured by a moving potential detector.

FIG. 4 diagrammatically shows as broken lines bright discharge curves $U_{E1}$, $U_{E2}$, $U_{E3}$, . . . and the dark discharge curve $U_S$ of an electrostatic charge image as a function of the exposure time. These measurements were carried out by means of a potential detector moved along the printing plate. Several discharge curves of the bright areas for different charge levels of the printing plate are drawn in. For example, the printing plates can be charged to values of $U_{O1}=-580$ V, $U_{O2}=-520$ V and $U_{O3}=-480$ V. In an ideal case, there should be no discharge of the dark areas, so that the potential $U_D$ of the dark areas should lie on the straight solid line parallel to the time axis and passing through the surface potential $U_O$ of charging. In practice, however, a certain discharge of the dark areas also takes place, so that the actual potential curve is given by the broken line dark discharge curve $U_S$ of the dark areas. This discharge in the dark areas is the result of light which is scattered at the optics and passes into the dark area, of different blackness densities of the dark areas in the originals and of different dark decrease rates. The potential decrease in the dark area as compared with the surface potential $U_O$ of charging is of the order of magnitude of about 80 V. The surface potentials $U_{Ri}$ of the residual charges, corresponding to the charging potentials $U_{Oi}$, are for example $U_{R1}=-160$ V, $U_{R2}=-130$ V and $U_{R3}=-115$ V.

At the time $t_E$ when the exposure source is switched on, the decrease of the surface potential starts in the bright areas of the electrostatic charge image on the printing plate, corresponding to the discharge curve belonging to the particular charging potential. The potential difference $\Delta U_i=U_{Si}-U_{Ei}$ is continuously compared by the potential detector moved along the printing plate with a given set value $\Delta U_{ideal}$, which will be explained in more detail in connection with FIG. 5.

Figure 5:
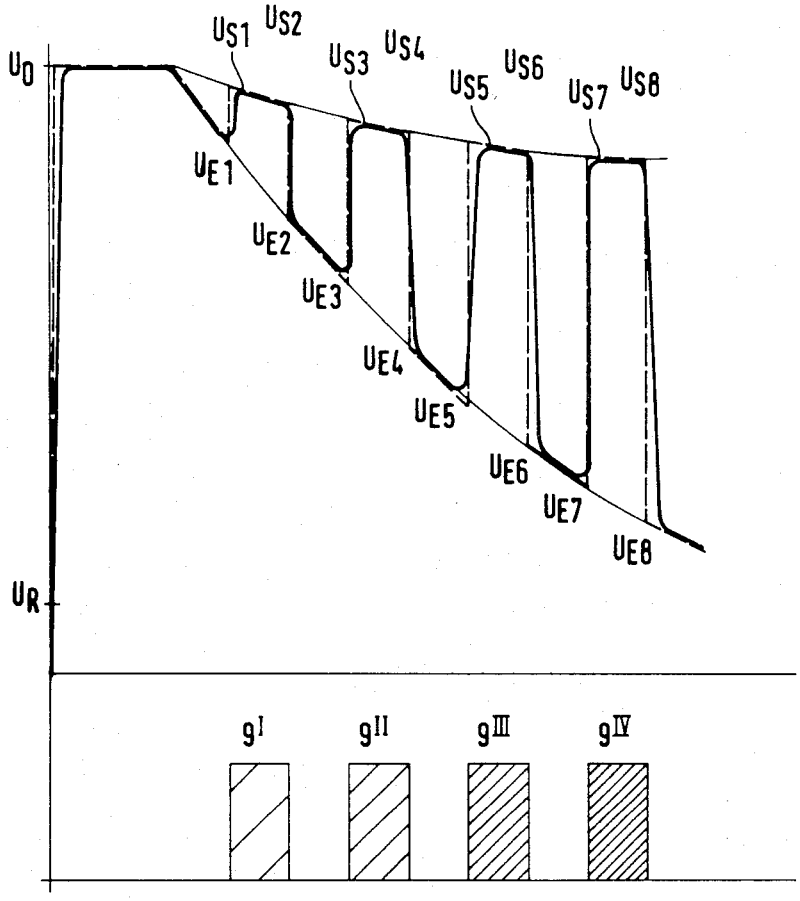
FIG. 5 shows the curve of the surface potentials in a strip pattern in the edge zone of a printing plate during exposure.

At the start of exposure, the potential detector 3 is moved over the strip pattern and the distribution of the surface potentials, the theoretical shape of which is approximately as shown diagrammatically in FIG. 5 by the broken lines, is measured. The actual shape approaching this theoretical shape is drawn in solid lines. The associated curve of the surface potentials in the individual bright and dark areas during the exposure is plotted in the drawing above the strip patterns. The charging of the printing plate to a surface potential $U_O$ and the discharge, starting on exposure, in the first bright area of the printing plate take place in the first section. As soon as the first dark area $9^I$ is scanned, the surface potential rises from $U_{E1}$ to $U_{S1}$. Corresponding to the degree of blackening in the dark area and to the other parameters described above, the surface potential within the area $9^I$ decreases only slightly down to a value of $U_{S2}$. In the next following second bright area, the surface potential decreases sharply to $U_{E3}$, rises again at the start of the adjoining second dark area $9^{II}$ to $U_{S3}$ and slightly decreases to $U_{S4}$ at the end of the dark area. In the adjoining bright area, the surface potential decreases to $U_{E5}$ and then rises again to $U_{S5}$ in the subsequent dark area. This sequence continues analogously through the remaining bright and dark areas. The potential difference $\Delta U_i=U_{Si}-U_{Ei}$ is formed from each of the surface potentials having the same indices i and is compared with an associated given set value $\Delta U_{ideal}$. When there is agreement between the potential difference and the set value, or when the set value is exceeded, the exposure is terminated. The residual charge potential $U_R$ of the bright area measured last before the end of exposure gives the basis for determining the counter-voltage for the developing electrode, whereas the charging potential $U_O$ is utilized for determining the required charging voltage for the next printing plate.

Since an image of the bar pattern is formed as a strip pattern during the exposure under the same conditions under which the image of the original is formed on the uniformly charged printing plate, the discharge or the curve of the surface potentials in the strip pattern follows the curve of the surface potentials in the electrostatically latent charge image, so that the measurement of the potential difference in the strip pattern can be carried out as representative of the direct measurement of the potential difference in the latent electrostatic charge image, without the electrostatically latent charge image being affected by the formation of an image of the potential detector during the measuring step.

The set value $\Delta U_{ideal}$ depends above all on the particular toner, which may be liquid toner or dry toner, on the constancy of its triboelectric charge and on the toner application or development method and, secondarily, on the type of printing plate. Within the scope of the toner application process, the rate of applying toner here plays a decisive role. For a conventional printing plate of the Elfasol® type, the absolute value of the potential different $\Delta U_{ideal}$ is, for example, 330 V±100 V for development with a dry toner, and 230 V±100 V for development with a liquid toner. The potential difference $\Delta U_{ideal}$ for optimum contrast between the bright and dark areas after development is determined at the start for toner, development and printing plate as the parameters and is stored for recall.

FIG. 6 shows a basic block diagram of an arrangement for controlling the exposure by reference to the measurement of the residual charge potential of exposed printing plates. The potential detector 3, the mode of operation of which will be described below, supplies as its output signal an a.c. voltage signal which is fed to a signal converter 11 and is converted in the latter into a d.c. voltage signal. This d.c. voltage signal is fed to an impedance converter or buffer 12 which ensures that the d.c. voltage signal is passed on with low resistance to one input of a comparator 13, to the other input of which an adjustable comparison voltage is applied which is supplied by a device 15, such as, for example, a memory or a ten-turn potentiometer, and which is equal to the desired residual charge potential of the exposed printing plate. The switching threshold of the comparator 13 can be freely selected, and the actual charge is compared in the comparator, after a defined exposure time, with the set value corresponding to the desired residual charge potential at the time of terminating the exposure. As long as the surface potential of the actual charge as an absolute value is greater than the set value, the exposure is continued. As soon as the measured surface potential is equal to or smaller than the set value, the comparator 13 emits an output signal to a shutter 14 in the exposure path, which is closed and thus terminates the exposure of the printing plate. The impedance converter 12, the comparator 13 and the set value-adjusting device 15 form a control device 51 which is drawn is broken lines.

If the exposure of the printing plate is carried out in an exposure camera, the shutter 14 is a camera shutter. In place of the shutter 14, it is also possible to actuate a relay which, for example, interrupts the voltage fed to an exposure source. After termination of the exposure, the printing plate is transported to a developing device which is not shown and in which toner is applied to the plate.

In the arrangement according to FIG. 6, a microprocessor control, although not shown, can be used which then replaces the impedance converter 12, the comparator 13 and the set value-adjusting device 15. The output signal of the signal converter 11 is then fed directly to the microprocessor which emits a digital signal via the digital output to the shutter 14 or to a switching transistor for actuating a relay which, for example, interrupts the voltage fed to an exposure source.

FIG. 7 shows a block diagram of an arrangement which can also be used for controlling the exposure, corona and developing electrodes, based on the measurement of the potential difference between the bright and dark areas of an exposed printing plate. The surface potential measured by the potential detector 3 emits an a.c. voltage output signal which is fed to a signal converter 16 which converts the a.c. voltage signal into a d.c. voltage signal. The sign of the d.c. voltage depends on the phase of the a.c. voltage signal in the initial position of the measuring electrode of the potential detector. If the initial position of the measuring electrode is such that the signal passes through a maximum, that is to say the phase is positive, a positive d.c. voltage is generated in the signal converter. If, conversely, the initial position of the measuring electrode is such that the a.c. voltage signal passes through a minimum, that is to say the phase is negative, a negative d.c. voltage signal is generated in the signal converter 16. The output signal of the signal converter 16 is fed to a control device 52 which is drawn in broken lines and which comprises an amplifier 17 as well as an analog/digital converter 18 which is combined with a microprocessor 19, a digital output 20 and a digital/analog converter 21 to form a unit. The control of the microprocessor 19 is programmed in such a way that the measured signal, which is supplied by the potential detector 3 and which corresponds to the potential difference between the dark discharge potential and the bright discharge potential, is compared with a stored set value. If the two values are in agreement, the digital output 20 emits a signal to the shutter 14 in order to close the latter and to terminate the exposure. Also, the digital/analog converter 21 generates two output signals which, amplified in high-voltage amplifiers 22 and 23, are fed to a corona supply 24 and to a developing electrode supply 25, respectively.

Figure 8:
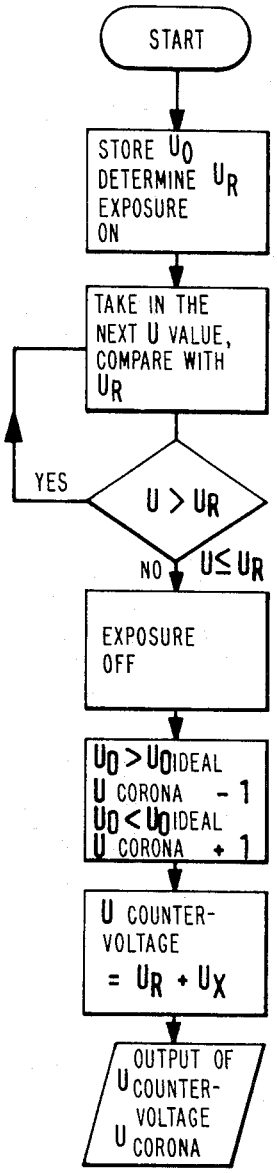
FIG. 8 shows a flowchart for a program for controlling the circuit arrangement according to FIG. 6.
Figure 9:
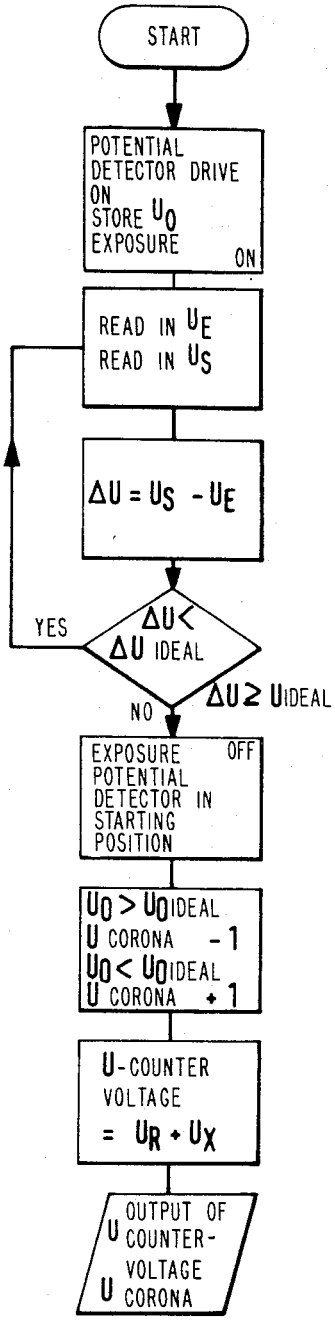
FIG. 9 shows a flowchart of a program stored in a microprocessor of the circuit arrangement according to FIG. 7.

FIGS. 8 and 9 show the flowcharts for the circuit arrangements according to FIGS. 6 and 7, respectively, it being assumed that both circuit arrangements are fitted with a microprocessor. With reference first to FIG. 8, it is a flowchart for the embodiment of FIG. 6 in which a stationary detector is used. After the start of exposure, the surface potential $U_0$, measured by the potential detector, of the charged printing plate is stored in the random access memory of the microprocessor and the respective residual charge potential $U_R$ is determined. Matching pairs of charge potentials $U_O$ and residual charge potentials $U_R$ are stored in the microprocessor in the form of tables. In the next step, the surface potential U measured by the potential detector is compared with the residual charge potential $U_R$. As long as the potential U is greater than the residual charge potential $U_R$, this comparison is continued. As soon as the measured potential U is smaller than or equal to the residual charge potential $U_R$, the exposure is switched off.

Furthermore, the charge potential $U_O$ is compared in the microprocessor with a given set value $U_{Oideal}$ and, if $U_O$ is greater than $U_{Oideal}$, the charging corona is controlled such that the corona voltage $U_{corona}$ is reduced by one step. This is indicated in the sequence diagram by the expression $U_{corona}-1$. If the surface potential $U_O$ is smaller than $U_{Oideal}$, the voltage of the charging corona is set one step higher, and this is indicated in the sequence diagram by $U_{corona}+1$.

Moreover, the voltage $U_{counter\text{-}voltage}$ of the developing electrode is set equal to $U_R+U_x$, where $U_R$ is the residual potential and $U_x$ is a parameter which represents an empirical value between 10 and 120 V. For example, if the residual charge potential is $-100$ V, the amount $U_x=-50$ V is selected so that a counter-voltage $U_{counter\text{-}voltage}$ of $-150$ V is applied to the developing electrode. This ensures that the development proceeds without background.

In the last step in the flowchart according to FIG. 8, the output of the counter-voltage $U_{counter\text{-}voltage}$ for the developing electrode control and the output of the corona voltage $U_{corona}$ for the corona control are given by the microprocessor.

The flowchart of FIG. 9 is to be read in conjunction with the circuit diagram according to FIG. 7, and it relates to the microprocess control of a circuit arrangement with a moving potential detector. After the start, the exposure and the drive for the potential detector are switched on and the charging potential $U_O$ is stored in the random access memory of the microprocessor. During the movement of the potential detector, the surface potentials along the dark discharge curve $U_S$ and the associated surface potentials of the bright discharge curve $U_E$ are continuously measured by the potential detector and read into the random access memory. In the microprocessor, the potential difference $\Delta U=-U_S-U_E$ is formed and compared with a given set value $\Delta U_{ideal}$. As long as the potential difference $\Delta U$ is smaller than $\Delta U_{ideal}$, this comparison is continued and each newly formed potential difference is compared with $\Delta U_{ideal}$.

As soon as the potential difference $\Delta U$ is greater than or equal to $\Delta U_{ideal}$, the exposure is terminated and the potential detector is moved into its starting position. At the same time, the charging potential $U_O$ is compared with a given value $U_{Oideal}$ and, depending on whether $U_O$ is greater than $U_{Oideal}$ or smaller than $U_{oIdeal}$, the corona voltage $U_{corona}$ is reduced by one step or increased by one step. This is indicated in the flowchart by the expression $U_{corona}-1$ and $U_{corona}+1$, respectively. The counter-voltage $U_{counter\text{-}voltage}$ to be applied to the developing electrode is obtained from $U_R+U_x$, where $U_R$ is the residual charge potential of the printing plate at the end of exposure and $U_x$ is an empirical value in the range from 10 to 120 V, which is added to the residual charge potential in order to ensure that a backgroundfree image is obtained in the development with toner. Finally, the output of the counter-voltage $U_{counter\text{-}voltage}$ and of the corona voltage $U_{corona}$ is given to the controls of the developing electrode and of the charging corona.

In order to obtain a background-free image after the development with toner, the printing plate and the measuring arrangement is also illuminated at a light intensity which corresponds to the background density under the most unfavorable conditions, such as are present, for example, in the shadow region of a cut edge of a part of composed matter. In order to simulate or establish these conditions, a gray field of appropriate density can be provided in opaque or transparent form at or over the edge of the original or the head of the potential detector can be covered with a gray filter of the desired density. The density of the gray field is here in the range from 0.05–0.5, in particular at a value of 0.26. If the counter-voltage of the developing electrode is then applied at the same voltage level as the residual potential of the printing plate in the area exposed and measured by the potential detector or in the printing plate area exposed through the image of the gray field, the images of all the image areas up to this optical density are not covered with toner. Another advantage here is the reduced influence of various sources of errors, such as, for example, zero drift and additional inclusion of shadow potentials of the measuring probe, on the measured result.

Figure 10:
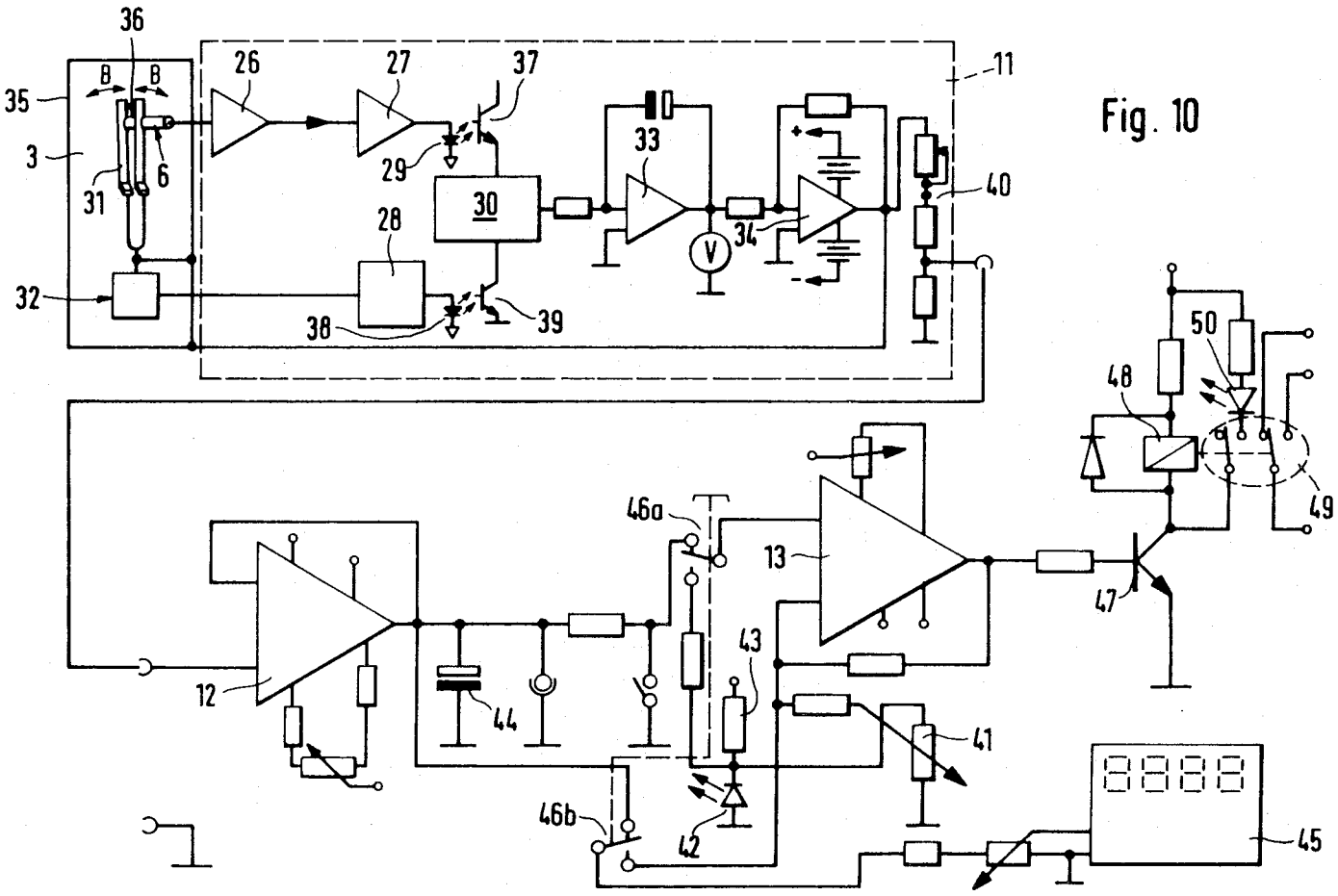
FIG. 10 shows circuitry details of the block diagram according to FIG. 6.

Circuitry details of the circuit arrangement according to FIG. 6 are described by reference to FIG. 10. The known potential detector 3 is enclosed by a metal housing 35 which has an aperture 36 and surrounds the measuring device and screens it from external electric fields. The aperture 36 forms a measuring aperture for the measuring electrode 6. A tuning fork or vibrating fork 31 in the metal housing is set into mechanical vibration, as indicated by the two double arrows B,B, by an oscillator 28 via a drive 32, the frequency of which can be tuned, and is electrically connected to the metal housing 35. The arms of the vibrating fork 31, which vibrate towards and away from one another, operate as a chopper which periodically opens and closes the measuring window 36. The electric force lines emanating from the surface potential of the latent electrostatic charge image on the printing plate run through the measuring aperture to the measuring electrode 6 and are interrupted by the arms, moving to and fro, of the vibrating fork 31 which move transversely to the lines of force.

As a result, a chopped alternating voltage is induced in the measuring electrode 6, the amplitude of this voltage being proportional to the voltage difference between the surface potential on the printing plate and the potential of the vibrating fork, which is electrically connected to the metal housing 35. The phase of the induced alternating voltage is determined by the polarity of the direct voltage which is applied to the measuring electrode 6 or to the metal housing 35 of the potential detector 3. The a.c. voltage signal of high impedance, induced in the measuring electrode 6 is converted into a d.c. voltage signal in the signal converter 11 which is drawn within broken lines in FIG. 10.

The induced a.c. voltage signal of high impedance is transformed by an impedance preamplifier 26 into a signal of low impedance and fed to a signal amplifier 27, the output signal of which is passed via an opto-coupler or photo-coupler, consisting of a light-emitting diode 29 and a phototransistor 37, to a phase detector 30. The amplitude and polarity of the d.c. voltage output signal of the phase detector 30 are given by the amplitude and phase of the induced a.c. voltage signal relative to the reference signal applied to the measuring electrode 6. A signal of the oscillator 28, by reference to which the initial position of the measuring electrode 6 is determined, is fed to the phase detector 30 via an opto-coupler or photo-coupler, consisting of a phototransistor 39 and a light-emitting diode 38. When the vibrating fork 31 opens the window between the measuring electrode and the printing plate, the phase and the d.c. voltage output signal are positive. Otherwise, the phase and the d.c. voltage output signal are negative. The d.c. voltage output signal of the phase detector 30 is integrated by an integrator 33 for low d.c. voltages. The polarity of the output signal of the integrator 33 is inverted to the polarity of the surface potential to be measured of the printing plate. The output signal of the integrator 33 is, on the one hand, indicated via a voltmeter V and, on the other hand, fed to a high-voltage amplifier 34. The output signal of the high-voltage amplifier 34 is, on the one hand, fed back to the metal housing 35 of the potential detector 3, in order to bring the latter to the same potential as that of the plate surface to be measured, and, on the other hand, is fed via a voltage divider 40, which comprises a variable resistor and two fixed resistors, to the impedance converter 12 of the control circuit for determining the residual charge potential at the end of the exposure of the printing plate.

In the impedance converter 12, the impedance of the measured d.c. voltage signal is reduced. The output of the impedance converter 12 is connected to one input of a comparator 13, the other input of which is connected to a ten-turn potentiometer 41 for adjusting and feeding the particular desired set value of the residual charge potential. A reference voltage of a light-emitting diode 42 which, together with a resistor 43, forms a voltage divider is applied to the ten-turn potentiometer 41. The light-emitting diode 42 also serves for indicating whether a voltage is or is not applied to the ten-turn potentiometer 41. Between the output of the impedance converter 12 and one input of the comparator 13, a filter capacitor 44 is connected which filters out any a.c. voltage signal components which may still be present in the measured d.c. voltage signal. The output of the comparator 13 is fed back via a resistor to the input, to which the set value of the residual charge potential is applied. The set value signal is inverted relative to the measured signal. A digital voltmeter 45 measures, depending on the position of a key **46*a*, 46*b*, the measured signal at one input or the set value signal at the other input of the comparator 13. If the measured signal and the set value signal are in agreement, the comparator 13 emits an output signal which actuates a switching transistor 47 for a switching source 48, which transistor changes over a switch 49, whereby, for example, the shutter 14 in the arrangement according to FIG. 6** is closed and the exposure is terminated.

A light-emitting diode 50 is connected to the switch as an indicator.

As already mentioned in connection with FIG. 6, a microprocessor control can be provided in place of the control circuit consisting of the impedance converter 12, the comparator 13 and the set value-adjusting device 15. The invention has been described in detail with reference to the preferred embodiments; however, it is understood that variations and modifications can be effected without departing from the spirit and scope of the invention.

What is claimed is:

1. A method for maintaining a given potential ratio in the exposure of electrostatically charged light-sensitive layers on carriers, on which an electrostatic latent image of an original is formed during the exposure comprising the steps of:

(a) charging the light-sensitive layer to a given surface potential;

(b) measuring the surface potential in a bright area of the light-sensitive layer by means of an electrostatic potential detector;

(c) continuously comparing the measured surface potential with a set value of the residual potential of the light-sensitive layer; and (d) terminating the exposure when the measured surface potential bears a predetermined relationship to the given set value.

2. The method as claimed in claim 1, wherein each given surface potential of a charge has a predefined associated residual potential corresponding to the residual potential of the light-sensitive layer after discharge, wherein said set value is defined by said associated residual potential.

3. The method as claimed in claim 2, wherein the exposure is terminated when the surface potential is equal to or smaller than the associated residual potential.

4. The method as claimed in claim 1, wherein each given surface potential of a charge has a pre-defined associated potential difference corresponding to the surface potential of the dark areas of the exposed latent image minus the surface potential of the bright areas of the exposed latent image wherein said set value is defined by said associated potential difference and wherein the step of measuring the surface potential comprises measuring the potential difference between the surface potential of bright areas and the surface potential of dark areas.

5. The method as claimed in claim 4, wherein the exposure is terminated when the measured potential difference is equal to or greater than the preferred associated potential difference.

6. The method as claimed in claim 1, further comprising a step before said step (a) of providing a gray field of a density in the range from 0.05 to 0.50 adjacent to an edge of an original to be copied, and wherein a counter-voltage applied to a developing electrode is at an equal voltage level as a residual potential of a printing plate in an area of the printing plate which is exposed through an image of the gray field.

7. The method as claimed in claim 1, further comprising a step before said step (a) of covering a head of the potential detector with a gray filter of given density in the range from 0.05 to 0.50, and wherein a counter-voltage applied to the developing electrode is at an equal voltage level as a residual potential of a printing plate after exposure in an area of the printing plate which is measured by the potential detector.

8. An arrangement for controlling an electrostatic printing operation using a light-sensitive layer comprising:

a potential detector means for detecting the potential of an electrostatic charge on a bright area of said light-sensitive layer, and for producing a.c. signals indicative of said detected potential;

a signal converter means responsive to said potential detector for converting said a.c. signals into d.c. signals;

a control means responsive to said signal converter for comparing the value of said d.c. signals with a first set value of a residual charge of said light-sensitive layer, and for outputting a control signal when said d.c. signals and said set value achieve a predetermined relationship; and shutter means, resposive to said control device, for terminating exposure of said light-sensitive layer in response to said control signal.

9. The arrangement as claimed in claim 8, wherein the control device comprises an impedance converter, a comparator, and a set value-adjusting device, and wherein an output of the impedance converter is connected to one input of the comparator, and an output signal of said set value-adjusting device is applied to another input of the comparator, the magnitude of the output signal being adjusted according to the set value of the potential ratios.

10. The arrangement as claimed in claim 9, wherein the adjusting device comprises a memory means in which potential values are stored which correspond to residual potentials of bright areas of the exposed light-sensitive layer and which are mapped to the surface potentials given by the level of charging at the start of the exposure.

11. The arrangement as claimed in claim 8, wherein the control device comprises a microprocessor in which a program for controlling said shutter means is stored.

12. The arrangement as claimed in claim 11, wherein the control device comprises an amplifier with a following analog-digital converter, a microprocessor, a digital output and a digital/analog converter, and wherein the digital/analog converter has two outputs which are connected via high-tension amplifiers to a corona control for the voltage of a charging corona and to a developing electrode control for the voltage of a developing electrode.

13. The arrangement as claimed in claim 11, wherein, in the control device, the potential values of predetermined surface potentials ($U_{Oi}$) and the associated residual charge potentials ($U_i$), with i an integer, are stored and their difference ($U_i = U_{Oi} - U_{Ri}$) is formed and compared with the difference between the measured surface potential of the potential detector and the associated residual charge potential, in order to control the shutter means to terminate exposure when the differences are of equal magnitude.

14. The arrangement as claimed in claim 8, wherein the potential detector is arranged in a fixed position outside the area of the latent electrostatic image at a distance of about 0.2 to 1.5 mm from the light-sensitive layer, above the edge zone of a printing plate.

15. The arrangement as claimed in claim 8, wherein the potential detector is arranged at a distance of 0.2 to 1.5 mm from the light-sensitive layer in a holder which is movable during the exposure along a guide over the edge zone of a printing plate.

16. The method as set forth in claim 2, further comprising the steps of:

(e) comparing the given surface potential with a predetermined value;

(f) reducing a supply voltage to a charging corona if the given surface potential is greater than the predetermined value; and (g) increasing a supply voltage to a charging corona if the given surface potential is less than the predetermined value.

17. The method as set forth in claim 16, wherein said predetermined value is an ideal given surface potential.

18. The method as set forth in claim 4, further comprising the steps of:

(e) comparing the given surface potential with a predetermined value;

(f) reducing a supply voltage to a charging corona if the given surface potential is greater than the predetermined value; and (g) increasing a supply voltage to a charging corona if the given surface potential is less than the predetermined value.

19. The method of claim 18, wherein said predetermined value is an ideal given surface potential.

20. The method as set forth in claim 2, further comprising the steps of:

(e) adjusting the residual potential measured upon termination of exposure in accordance with a predetermined value; and (f) adjusting a developing electrode supply voltage in accordance with said adjusted residual potential.

21. The method as set forth in claim 4, further comprising the steps of:

(e) adjusting the residual potential measured upon termination of exposure in accordance with a predetermined value; and (f) adjusting a developing electrode supply voltage in accordance with said adjusted residual potential.

22. The apparatus of claim 8, further comprising means for comparing the value of said d.c. signals with a second set value and for outputting a second control signal indicative of said comparison; and means for increasng and decreasing a corona supply voltage in accordance with said second control signal.

23. The apparatus of claim 22, wherein said second set value is an ideal given surface potential.

24. The apparatus of claim 8, further comprising means for adjusting said d.c. signals in accordance with a second set value; and means for increasing and decreasing a developing electrode supply voltage in accordance with said adjusted d.c. signals.

25. The apparatus of claim 21, wherein said second set value is an empirical value between 10 and 120 V.

* * * * *

UNITED STATES PATENT AND TRADEMARK OFFICE

CERTIFICATE OF CORRECTION

PATENT NO. : 4,616,923

DATED : Oct. 14, 1986

INVENTOR(S) : Klaus REUTER

It is certified that error appears in the above—identified patent and that said Letters Patent is hereby corrected as shown below:

IN THE CLAIMS:

Column 13, line 48, kindly delete "preferred" and insert instead -- predefined --.

Column 13, line 62, kindly delete "the" and insert instead -- a --.

Column 14, line 14, kindly delete "resposive" and insert instead -- responsive --.

Signed and Sealed this

Tenth Day of March, 1987

*Attest:*

DONALD J. QUIGG

*Attesting Officer*

*Commissioner of Patents and Trademarks*